US005512028A

United States Patent [19]

Sparks, III

[11] Patent Number: 5,512,028

[45] Date of Patent: Apr. 30, 1996

[54] FITNESS IMPLEMENT

[76] Inventor: Robert W. Sparks, III, Rte. 1, Box 252B, Hutto, Tex. 78634

[21] Appl. No.: 206,800

[22] Filed: Mar. 7, 1994

[51] Int. Cl.[6] ..... A63N 1/32

[52] U.S. Cl. ..... 482/92; 482/906; 482/126; 482/110; 446/253

[58] Field of Search ..... 16/114 B, 114 R, 16/126, DIG. 12; D21/191, 198, 92; 403/396, 390, 391, 65 G; 174/152 G, 153 G, 167, 168; 441/69; 482/126, 92, 110, 906, 148; 446/254

[56] References Cited

U.S. PATENT DOCUMENTS

| | | | |
|---|---|---|---|
| 1,613,331 | 1/1927 | Schreiner | 446/253 |
| 2,118,114 | 5/1938 | Schenk | 482/126 |
| 2,846,714 | 8/1958 | Charlick | 16/114 B |
| 3,269,727 | 8/1966 | Samuel | D21/198 |
| 3,564,113 | 2/1971 | Kindler | 174/65 G |
| 3,695,210 | 10/1972 | Stein | 441/69 |
| 4,043,290 | 8/1977 | Holland | 441/69 |
| 4,451,035 | 5/1984 | Manzi | 482/126 |

OTHER PUBLICATIONS

Soc Nat Ind Aerospatiale May 1986 Fr 2573583.

*Primary Examiner*—Richard J. Apley
*Assistant Examiner*—Jerome Donnelly
*Attorney, Agent, or Firm*—David G. Henry

[57] ABSTRACT

Applicant's invention is of an improved flywheel exerciser and of an improved handle for engaging the exerciser's cord. The cord segments on either side of the flywheel are securely engaged by pinch grip blades within the two handles' body. Because the cord is easily disengaged from the pinch grip structure, the spatial separation of the handles is easily adjusted for different users. A two-part grommet structure eases the assembly and cord replacement for the exerciser. Applicant's handle, particularly a modified version which can be used to grasp medial sections of a cord, can be used to engage cording in many contexts other than that of use for a flywheel exerciser.

1 Claim, 6 Drawing Sheets

FITNESS IMPLEMENT

BACKGROUND OF THE INVENTION

1. Field of The Invention

Applicant's invention relates to apparatuses used to achieve or maintain physical fitness and more particularly to devices having forcibly yieldable components against which users apply force to facilitate muscular development and augmentation.

2. Background Information

The achievement and maintenance of physical fitness is, in its countless forms, a multi-billion dollar industry in the United States. While free weights and other gym-type physical fitness equipment appeared in the fitness industry scene many many years ago, a fairly recent niche in this industry relates to fitness equipment which is practical, yet highly effective for use in the home, or even away from home (such as for business travelers).

The enormous success of products such as the NORDIC TRACK and SOLO FLEX machines in the home fitness market is evidence of consumer demand for fitness apparatuses, at least for use in the home environment. A problem with machines such as these, however, relates to cost. At prices ranging from hundreds to thousands of dollars for each piece of equipment, products such as the NORDIC TRACK and SOLO FLEX machines are simply out of financial reach of most consumers.

Desires for fitness and health certainly are confined neither to persons who can afford expensive home fitness equipment nor to persons who are usually at home most mornings or evenings to use such machines. In part because of this, even the proliferation of fitness equipment such as the high-dollar, home-bound equipment such as mentioned before leaves available to competing vendors a huge market for relatively inexpensive, portable, yet effective fitness equipment.

The existence and extent of this latter market is evidenced by the high degree of success experienced by modestly-priced fitness products such as those marketed under the THIGH MASTER, BODY SLIDE, ABDOMINIZER and other now-familiar trademarks.

An attractive addition to the modestly priced, easily transported fitness equipment category of products is an exerciser which produces resistance by harnessing the rotational momentum of a turning flywheel. The flywheel exerciser includes two lengths of cord which pass respectively on either side of the flywheel's rotational axis. On either side of the flywheel, handles are affixed to the cord ends.

The device is used by initially rotating the flywheel while maintaining the handles in a relatively fixed orientation whereby the cords assume a highly twisted configuration. This tends to draw the handles closer together. The user then applies an expansive force to the cord segments by pulling in opposite directions on the two handles. Depending on the configuration of the handles, this can be done using the hands (in front or behind one's torso), one hand and one foot, etc. to exercise different muscle groups.

By applying expansive force to the handles of the flywheel exerciser, the cord segments unwind from their initial twisted configuration with an accompanying rotation of the flywheel and increase of spatial separation of the handles. Upon application of a sufficient extent and duration of force, the momentum of the flywheel effects a full unwinding of the cord segments and ultimately a re-winding to an opposite extreme to that at the initiation of the exercise routine. As a user continues to apply expansive force to the handles of the device, he or she sets up a reciprocating cycle of spatial contraction and expansion of the handles as the flywheel rotates to respectively wind and unwind the cords between oppositely directed extremes. The flywheel is ideally constructed of steel or another weight dense material. When at rest, the flywheel exhibits a significant degree of inertia which provides resistance to expansion of the handles during the unwinding phase of each cycle, and, when rotating, generates a substantial rotational momentum which, in turn, is translated into a significant force in opposition to the expansive forces applied by the user in resisting the rewinding phase of each cycle. This force against which the user moves the handles between fully contracted and expanded handle positions during use of the device serves to strengthen and condition whichever of the user's muscle groups as are utilized during the exercise regimen.

Flywheel exercisers of the prior art exhibit significant defects or deficiencies in their design and construction. Most such problems relate to the need of differing sized users to be able to adjust the length of the cord segments and thereby to adjust the outer limits of movement during exercise cycles. Remaining problems relate to difficulty of assembly and repair of the exercisers.

More specifically, the handles of prior known flywheel exercisers were not easily adjusted relative to the cord segments, but were connected to the cord segments using not easily disengaged knots, permanent clamps, etc. The increased labor involved in connecting such handles with the cord segments increased manufacturing expense. In addition, threading the cord segments through the flywheel cord holes was difficult and time intensive in prior art flywheel exercisers, thereby further increasing manufacturing costs.

SUMMARY OF THE INVENTION

It is an object of the present invention to provide a novel and improved flywheel exerciser.

It is another object of the present invention to provide a novel and improved cord grasping apparatus for grasping cords, ropes and the like.

It is another object of the present invention to provide a novel and improved cord grasping apparatus which provides an easily engaged and disengaged handle for use in securely clutching cord or rope segments.

It is another object of the present invention to provide a novel and improved cord grasping apparatus for incorporation into an improved flywheel exerciser.

It is yet another object of the present invention to provide an improved flywheel exerciser which exhibits improved cord/flywheel interface means and improved handles.

In satisfaction of these and related objectives, Applicant's present invention provides a novel and improved cord grasping handle which utilizes cord restraints for grasping cord segments, such as are used in flywheel exercisers as described above. Handles of Applicant's invention are easily engaged with and disengaged from the cordage used with Applicant's exerciser, yet exhibits a virtually fail-proof linkage between the handle and the cord during use.

By incorporating Applicant's improved handle, flywheel exercisers of Applicant's invention are more easily and quickly assembled during the manufacturing process. Also, the cords of Applicant's flywheel exerciser are more easily adjusted to differing lengths for use by persons of differing statures. Other improvements will be described below in the Detailed Description of the Preferred Embodiment.

DETAILED DESCRIPTION OF THE PREFERRED EMBODIMENT

Figure 1:
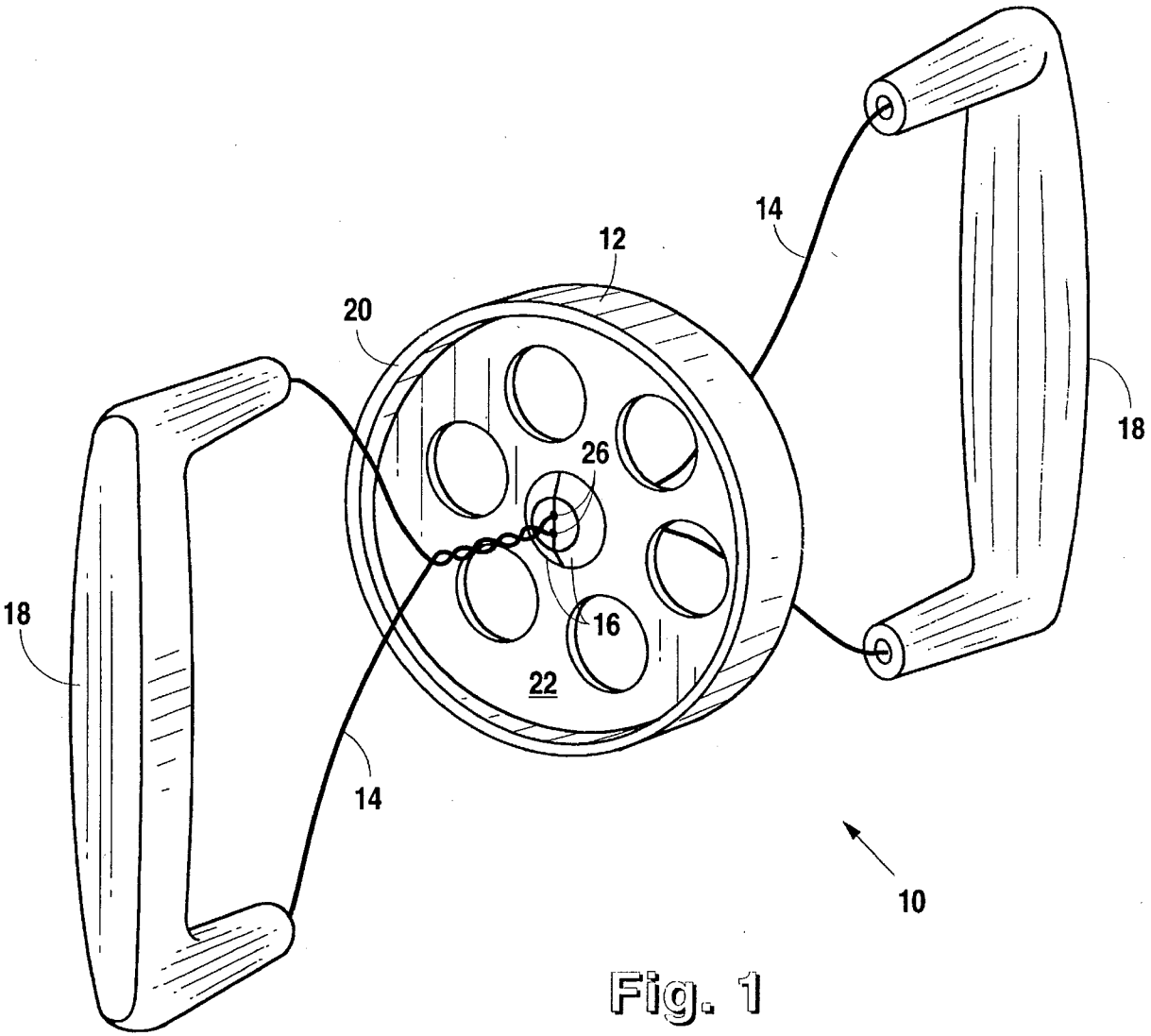
FIG. 1 is a perspective view of a flywheel exerciser of Applicant's invention.
Figure 2:
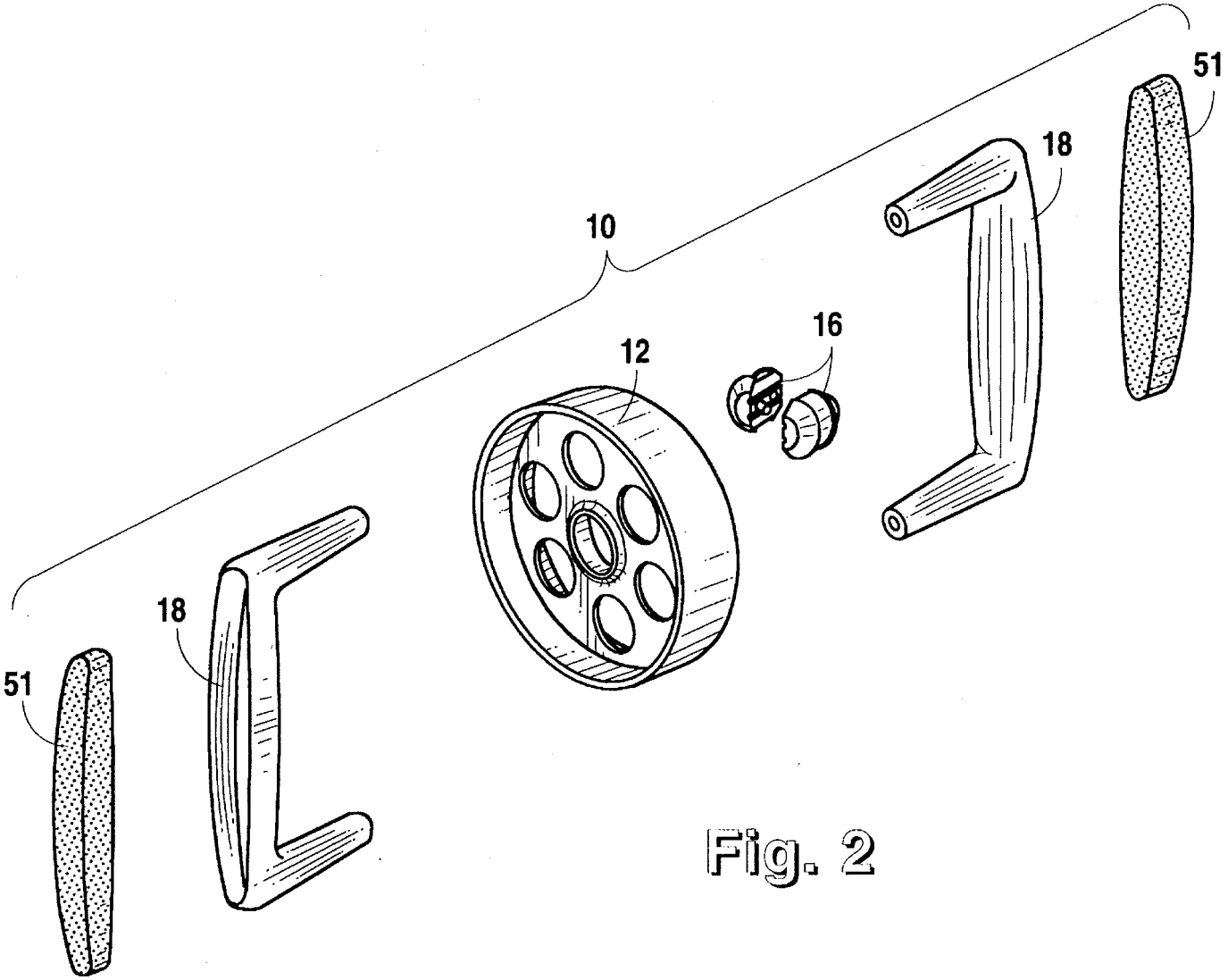
FIG. 2 is an exploded perspective view of the exerciser of FIG. 1.
Figure 3:
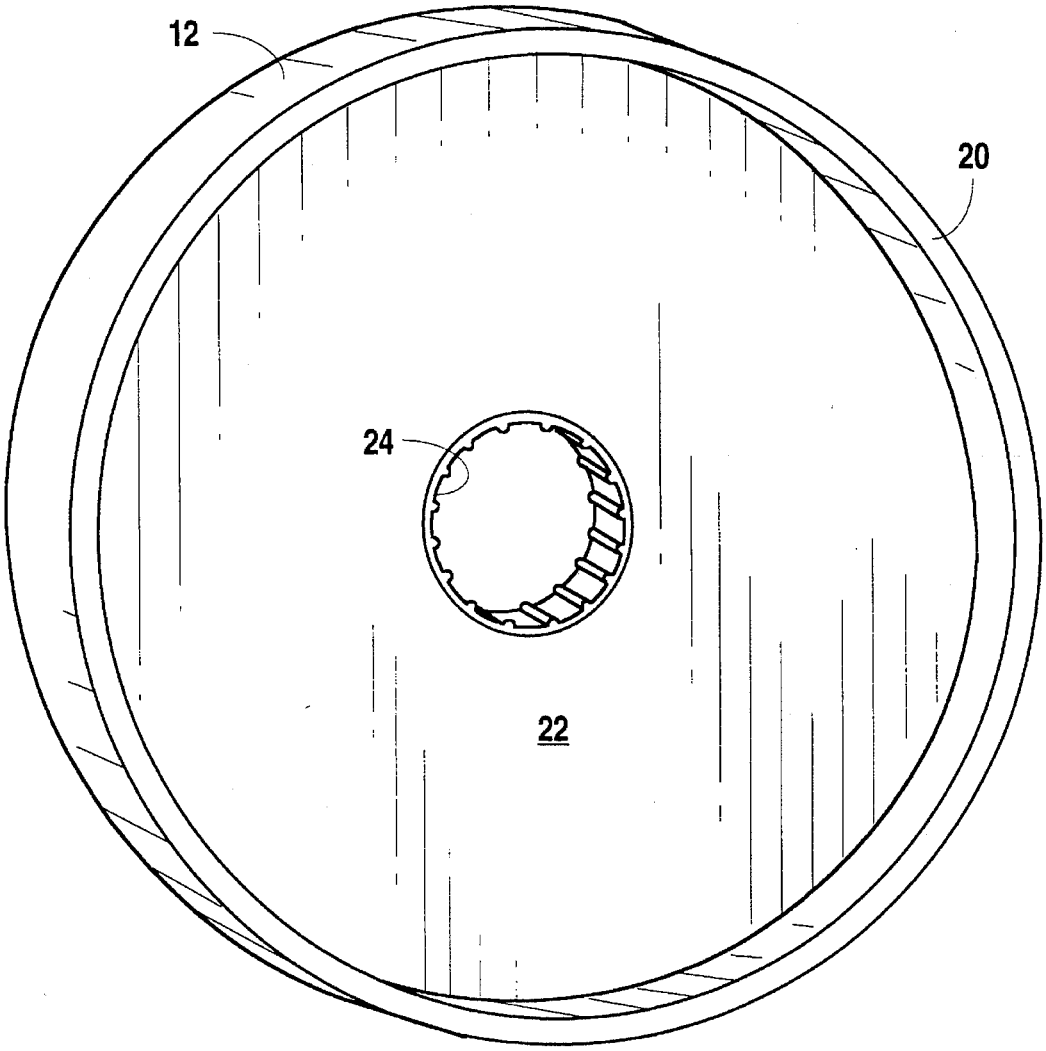
FIG. 3 is a perspective view of the flywheel (shown in solid, rather than vented form) of the exerciser of FIGS. 1 and 2.

Referring to FIGS. 1, 2, 3, and 9, Applicant's flywheel exerciser is identified generally by the reference number 10. Flywheel exerciser 10 includes a flywheel 12, cording 14, flywheel grommet halves 16, and handles 18.

Flywheel 12 is, in the preferred embodiment, a die-cast, chrome-plated zinc wheel substantially as shown in FIG. 1. All exposed margins of flywheel 12 are radiused for safety and aesthetic purposes (this feature may not be clearly distinguishable in the drawings). Flywheel 12 is approximately four inches (4") in diameter and weighs approximately twelve ounces (12 oz.) in the preferred embodiment. In order to achieve the greatest degree of rotational inertia and rotational momentum, and thereby realize the greatest degree of resistance from the least amount of disk mass, flywheel 12 is configured to exhibit a thickened rim section 20 which circumvents a relatively thin (and/or vented) hub disk 22. A grommet hole 24 is centered on the rotational axis of flywheel 12 and is sized and shaped for accommodating a grommet formed from two grommet halves 16.

Grommet halves 16 (shown in more detail in FIGS. 7 and 8) cooperatively define two cord holes 26 through which respectively pass two segments of cording 14. The purpose and benefits of grommet halves 16 will be discussed in more detail hereafter. The preferred cording for Applicant's exerciser, in terms of life expectancy, winding characteristics, etc., is a cord similar in characteristics to that manufactured pursuant to Mill Specification T-C-2754 as is commonly recognized in the cordage industry.

Figure 4:
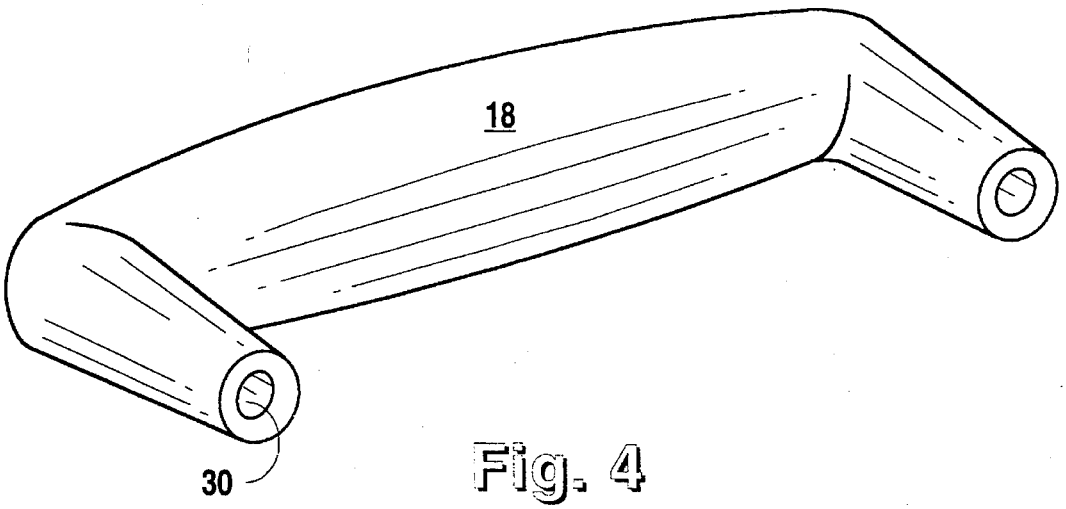
FIG. 4 is a perspective view of a handle of Applicant's invention from a superior perspective.
Figure 5:
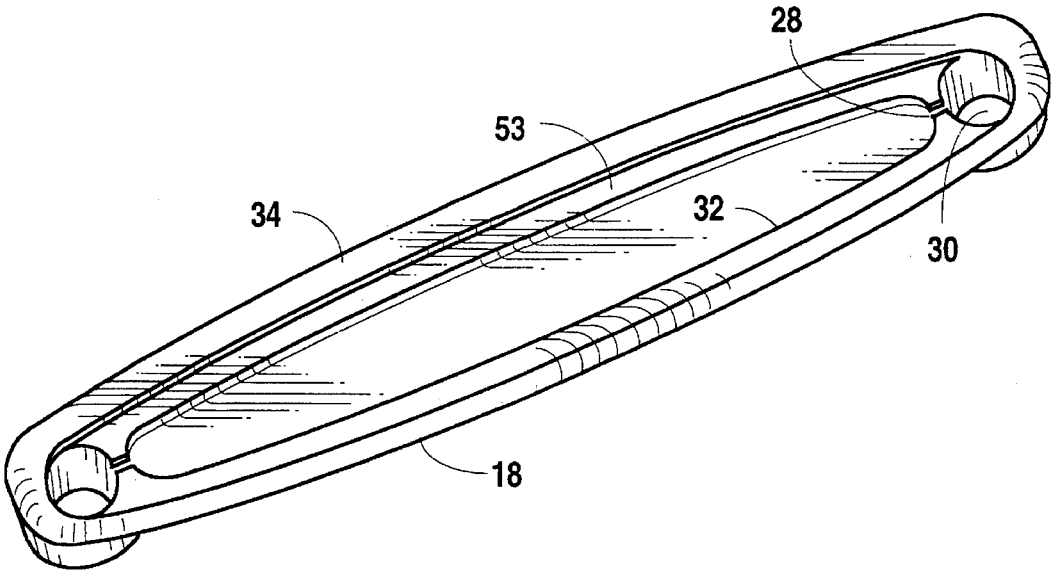
FIG. 5 is a top plan view of the handle of FIG. 4.
Figure 6:
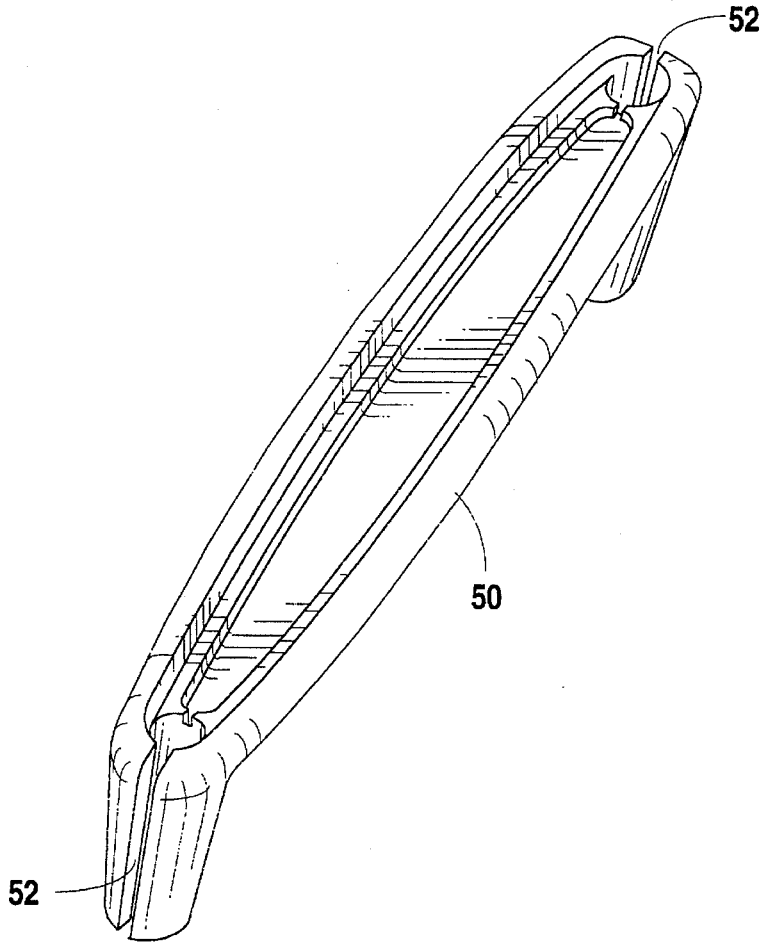
FIG. 6 is a perspective view of an alternative embodiment of a handle of Applicant's invention from an inferior perspective.

Referring to FIGS. 4 and 5, handles 18 of Applicant's invention are formed from molded, high density plastic in the preferred embodiment for use with Applicant's flywheel exerciser 10. The operative heart of handles 18 is a cord restraint structure configured of a pair of cord restraint blades 28 which are integral to the unibody construction of handles 18 in the preferred embodiment. On a first side of cord restraint blades 28 is defined, through the body of handle 18, a cord conduit 30, through which a segment of cording 14 extends while engaged with handle 18 (cording 14 is not depicted in FIGS. 4 and 6 so as to allow a clear view of the operative components of handle 18).

On the opposite side of cord restraint blades 28 from cord conduit 30 is defined a cord terminus trough 32. The end of a cord segment which is engaged with handle 18 resides in cord terminus trough 32. Cord restraint blades 28 are configured in handles 18 whereby they converge at a point near the bottom of trough 32, initially defining a wide gap near the top margin of trough 32.

A segment of cording 14 is engaged with handle 18 as follows: (1) a terminal portion of a segment of cording 14 is passed (in a "positive direction") through cord conduit 30 sufficient to extend at least an inch beyond the top 34 of handle 18; (2) the terminus of the cording 14 is positioned in trough 32; and (3) while maintaining the terminus of the cording 14 in trough 32 (such=as by pressing against cording 14 using one's fingers), cording 14 is pulled in a "negative direction" to lodge a segment of cording 14 between cord restraint blades 28. This process is repeated for each end of the handle 18 (assuming two cord termini are to be engaged with handle 18).

Engagement of a segment of cording 14 such as just described presupposes that a cording terminus is available to pass through cord conduit 30. Referring to FIG. 5, a highly utilitarian alternative embodiment 50 of Applicant's handle is provided for situations in which a cord terminus is not available, and a user wishes to engage a medial segment of cording, rope, string, etc. Exemplary uses for such a handle 50 would include the handling of fishing net cording, use on sailing vessels, use in various camping activities, and in many other environments in which cording, ropes, etc. are used.

Handle 50 substitutes cord conduits 30 of the, handle 18 embodiment with slots 52. A medial segment of cording 14 may merely be lain in slot 52, passed between cord restraint blades 28 and extended into trough 32.

For use with both embodiments of Applicant's handle 18 and 50 is an insert 51 which is to be formed of a foam-rubber type material and which is sized and shaped to lodge at and occlude the opening of cord terminus trough 32 during use of handles 18 and 52. Handles 18 and 50 are molded to exhibit a ledge 53 upon which the foam inserts 51 rest. Such an insert improves both the appearance of handles 18 and 52 during use, but also contains cord ends to prevent them from extending from trough 32 and causing discomfort to users such as when a segment of cording 14 might otherwise come to lie between a portion of handles 18 or 52 and a user's palm or finger(s).

Figure 7:
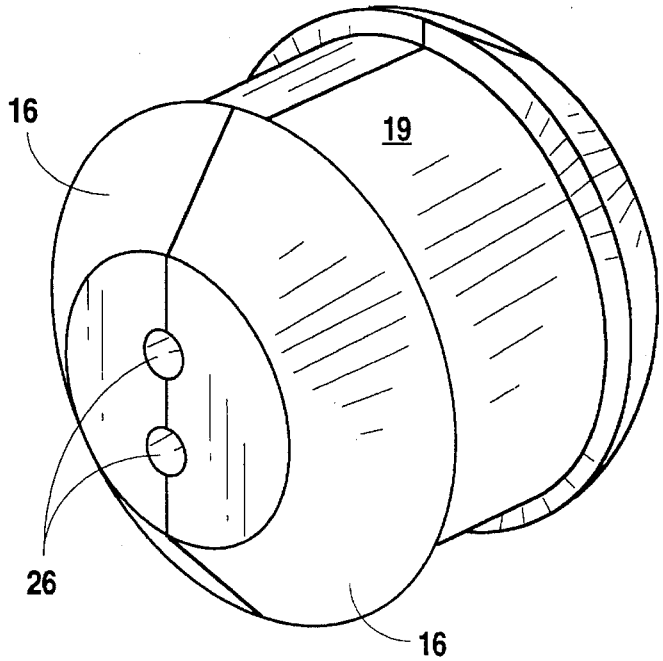
FIG. 7 is a perspective view of the hub grommet for use in the exerciser of FIG. 1.
Figure 8:
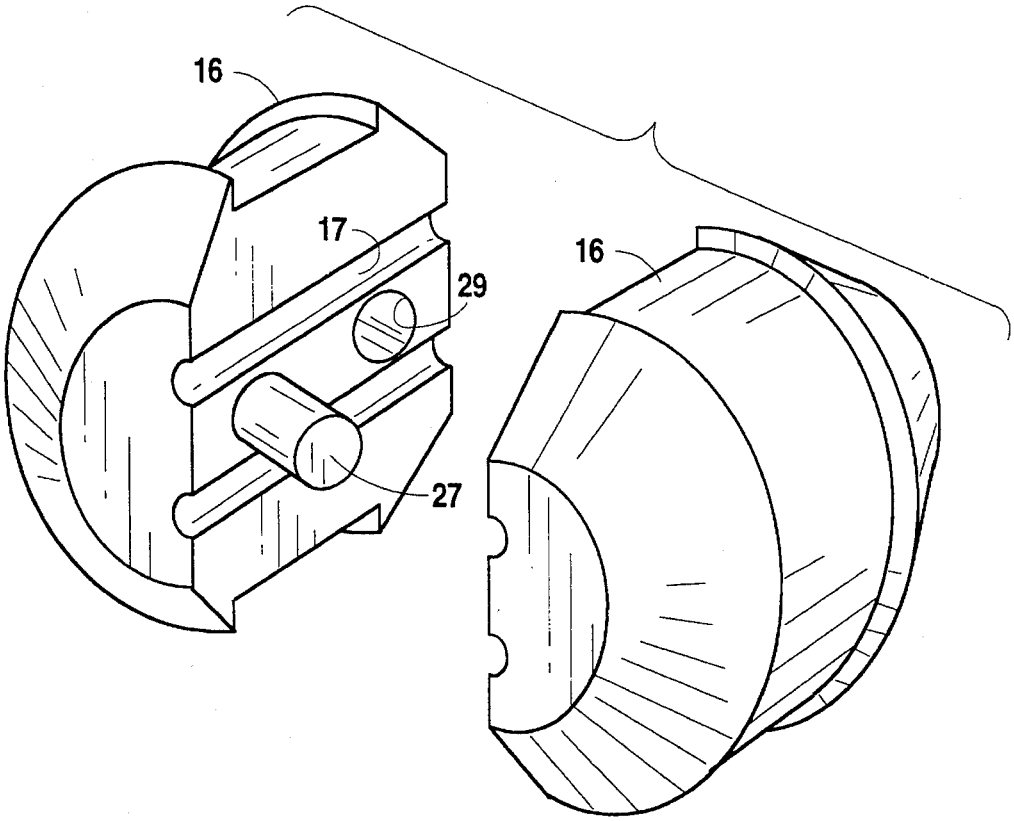
FIG. 8 is an exploded perspective view of the hub grommet of FIG. 7.
Figure 9:
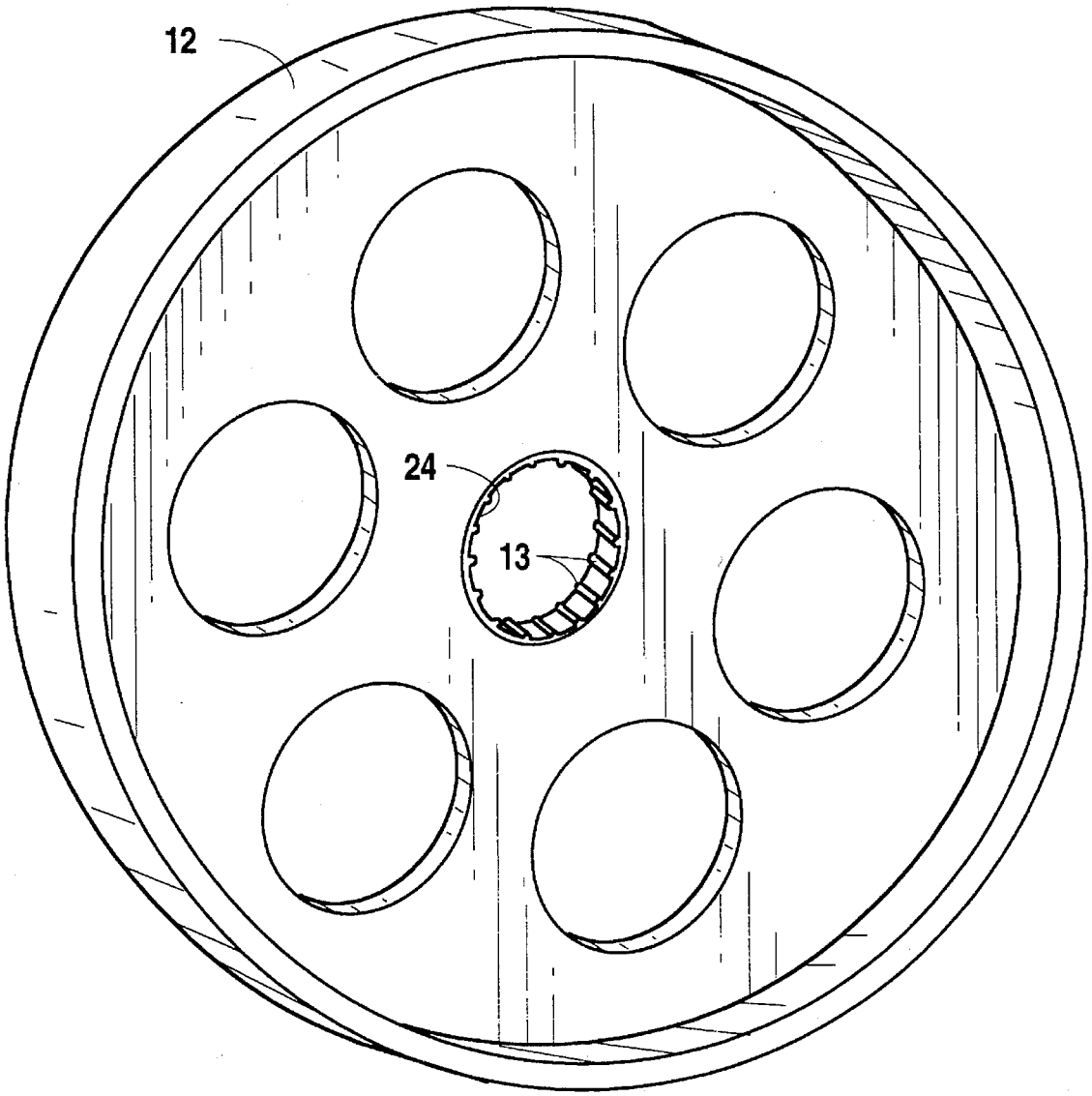
FIG. 9 is a perspective view of a vented embodiment of a flywheel for use in Applicant's exerciser.

Referring in combination to FIGS. 7 and 8, another of Applicant's improvements over prior art flywheel exercisers is found in the means selected for engaging the cording 14 with the flywheel 12. Rather than simply passing the cording 14 through holes drilled in flywheel 12 (which are difficult to "thread" and do not adequately resist slippage of the flywheel 12 on the cording 14 and would prematurely wear cording 14), Applicant employs grommet halves 16. Grommet halves 16 are, in the preferred embodiment, formed from any highly resilient, rubber-like material. Each grommet half 16 is molded to define two semi-circular troughs 17 positioned for jointly defining cord holes 26. Each grommet 16 also exhibits a circumferential recess 19 which aids in securely lodging the grommet halves 16 in grommet hole 24 of flywheel 12.

Referring principally to FIG. 8, both to ease the assembly process (by "holding" the grommet halves 16 in a correctly assembled arrangement), and to prevent migration of cording 14 from one hole 26 toward the other during use of exerciser 10 (thereby destroying the mechanical advantage provided by the para-axial placement of cording 14), complimentary pairs of pins 27 and pin receptacles 29 are molded into grommet halves 16. The pins 27 and receptacles 29 are mated as the grommet halves 16 are paired for assembly of the exerciser 10.

By utilizing grommet halves 16, Applicant's flywheel exerciser 10 is easier to initially assemble and is more easily repaired with respect to replacement of worn cording 14. Rather than "threading" cording 14 through two small holes, in assembly or replacing the cording 14 of Applicant's flywheel exerciser 10, one merely envelopes two cording segments in each of the two pairs of recesses 17, and then snaps the grommet halves 16 into grommet hole 24. The rubber-like material of grommet halves 16 provides a reasonably secure frictional engagement with cording 14 whereby little if any slipping of the flywheel 12 relative to the cording 14 occurs during use. In turn, a secure engagement exists between the grommet halves 16 and flywheel 12, in part, by virtue of splines 13 which radiate into grommet hole 24.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. An improved flywheel exerciser comprising:

a flywheel having an axially oriented grommet hole;

first and second grommet halves, said grommet halves jointly defining a circular grommet structure sized for press fit into said grommet hole of said flywheel, each said grommet half having first and second axially directed furrows positioned whereby, when said first and second grommet halves are juxtaposed to form said grommet structure, first and second cord holes are defined substantially symmetrically on either side of the rotational axis of said flywheel respectively by each of said first and second grommet half's first and second furrows;

first and second handles, each comprising:

a horizontal section having a first end, a second end, an upper part, and a lower part, said horizontal section defining a cord terminus trough having a first wall, a second wall, and a bottom, said trough extending substantially from said first end to said second end of said horizontal section;

first and second vertical sections having an upper end and a lower end, said upper ends of said first and second vertical sections respectively positioned at said lower parts of said first and second end of said horizontal section, the vertical sections extending substantially perpendicularly from said lower part of said horizontal section such that a C-shaped member is formed, each vertical section defining a conduit adapted to loosely receive a cord, said conduits communicating with said trough of said horizontal section; and first and second cord restraint structures, each said structure located within said cord terminus trough proximal to said first and second vertical section conduits respectively, each said restraint structure comprising a partition extending from said first wall of said trough to said second wall of said trough, said partition oriented perpendicular to an axis line drawn from said first end of said trough to said second end, said partition defining a vertically oriented gap extending substantially from said bottom of said trough to the top of said partition, said gap being narrowest at the point closest in proximity to said trough bottom and continuously and gradually widening therefrom;

a first cord extending from said cord terminus trough of said first handle, through said first cord restraint structure, into said first conduit, passing through said first cord hole of said grommet structure into said second handle first conduit through said second handle first cord restraint structure and terminating in said cord terminus trough of said second handle; and a second cord extending from said cord terminus trough of said first handle, through said second cord restraint structure, into said second conduit, passing through said second cord hole of said grommet structure into said second handle second conduit through said second handle second cord restraint structure and terminating in said cord terminus trough of said second handle whereby said first handle and said second handle are physically connected to said fly wheel such that when said handles are pulled in opposite directions, said cords tend to turn said flywheel.

* * * * *